US007279084B2

(12) United States Patent
Chalupa et al.

(10) Patent No.: US 7,279,084 B2
(45) Date of Patent: Oct. 9, 2007

(54) APPARATUS HAVING PLATING SOLUTION CONTAINER WITH CURRENT APPLYING ANODES

(75) Inventors: Radek P. Chalupa, Portland, OR (US); Harsono Siem Simka, Saratoga, CA (US); Sadasivan Shankar, Cupertino, CA (US); Daniel J. Zierath, Portland, OR (US); Iouri Lantassov, Minsk (BY); Terry T. Buckley, Dublin (IE); Anand Durairajan, Tigard, OR (US)

(73) Assignee: Intel Corporation, Santa Clara, CA (US)

( * ) Notice: Subject to any disclaimer, the term of this patent is extended or adjusted under 35 U.S.C. 154(b) by 604 days.

(21) Appl. No.: 10/773,643

(22) Filed: Feb. 6, 2004

(65) Prior Publication Data

US 2005/0173241 A1 Aug. 11, 2005

(51) Int. Cl.
*C25D 21/12* (2006.01)
*C25D 7/12* (2006.01)

(52) U.S. Cl. ..... 205/81; 205/83; 205/96

(58) Field of Classification Search ..... 205/81, 205/83, 96

See application file for complete search history.

(56) References Cited

U.S. PATENT DOCUMENTS 6,565,729 B2 * 5/2003 Chen et al. ..... 205/82
2005/0178667 A1 * 8/2005 Wilson et al. ..... 205/123

* cited by examiner

*Primary Examiner*—Roy King
*Assistant Examiner*—William T. Leader
(74) *Attorney, Agent, or Firm*—Schwabe, Williamson & Wyatt, P.C.

(57) ABSTRACT

A method for an electroplating cell which includes providing an anode chamber with at least two concentric anodes including an inner anode and an outer anode; generating a computer generated model with a simulation computer program; and selecting at least one current ratio from the computer generated model, with the computer generated model having a plurality of current ratios from which the at least one current ratio is selected and the one current ratio being a ratio of an inner electrical current to an outer electrical current. The method further includes applying the inner electrical current to the inner anode and the outer electrical current to the outer anode and adjusting the inner and outer electrical currents to incorporate the one current ratio. The generating of the computer generated model with the simulation computer program includes using a first iterative loop to determine a potential field in the anode chamber.

6 Claims, 7 Drawing Sheets

APPARATUS HAVING PLATING SOLUTION CONTAINER WITH CURRENT APPLYING ANODES

BACKGROUND OF THE INVENTION

1. Field of the Invention

The present invention relates to the field of electroplating, and in particular to electroplating equipment.

2. Description of Related Art

The manufacture of semiconductor devices often requires the formation of electrical conductors (interconnects) on semiconductor wafers. Such interconnects may be formed by electroplating (depositing) an electrically conductive material, such as copper, onto the wafer.

The adoption of increasingly thin copper seed layers in the current wafer processing technologies leads to increasing challenges in obtaining uniform film profiles with copper (Cu) electroplating, due to increasing electrical resistance of the underlying seed layer. As the seed layer becomes thinner due to technology demands, increasing wafer resistance leads to stronger "terminal effects" (center-thin, edge-thick profile) and the film less uniform, which leads to unacceptable film profiles for subsequent processing. Hardware changes to reduce terminal effects for thin films (thicknesses of approximately 0.5 microns) often leads to worse uniformity for thick films (thicknesses approximately greater than 1 micron). More specifically, these thick films have problems with "edge roll-offs" (center-thick, edge-thin). Systematic empirical hardware optimizations to generate acceptable film profiles are prohibitively expensive in cost and time. Moreover, different types of wafers also lead to different film profiles.

Referring to FIG. 1, a cross-sectional view of a cylindrically-shaped electroplating cell of the prior art is shown, with the cross-sectional view being taken from the center axis to the outer periphery of the cell. The cell includes a plating cup with two concentric, annular or ring-like anodes 1*a* and 1*b* and an anode separator 2 which separates the two anodes. An anode chamber wall 3 defines an anode chamber for containing a plating solution. The anode chamber wall 3 includes an anode membrane outer support ring 4*a* and a porous anode membrane 4*b* attached thereto, with the anode membrane 4*b* traversing the anode chamber. A porous diffuser membrane 5*a* is affixed to the diffuser support ring 5*b* and traverses the anode chamber. A wafer holder 6, holding a wafer 7*a*, is mounted above the anode chamber wall 3. The surface of the plating solution in the anode chamber is in contact with a lower surface 7*b* of the wafer 7*a*, which forms a cathode. The lower surface 7*b* touches or is wetted by the plating solution during the plating process. The plating solution is provided to the anode chamber by way of a solution inlet nozzle 8 positioned on the center axis of the electroplating cell.

DETAILED DESCRIPTION OF AN ILLUSTRATIVE EMBODIMENT

In the following description, for purposes of explanation, numerous details are set forth in order to provide a thorough understanding of the disclosed embodiments of the present invention. However, it will be apparent to one skilled in the art that these specific details are not required in order to practice the disclosed embodiments of the present invention. In other instances, well-known electrical structures and circuits are shown in block diagram form in order not to obscure the disclosed embodiments of the present invention.

Figure 1:
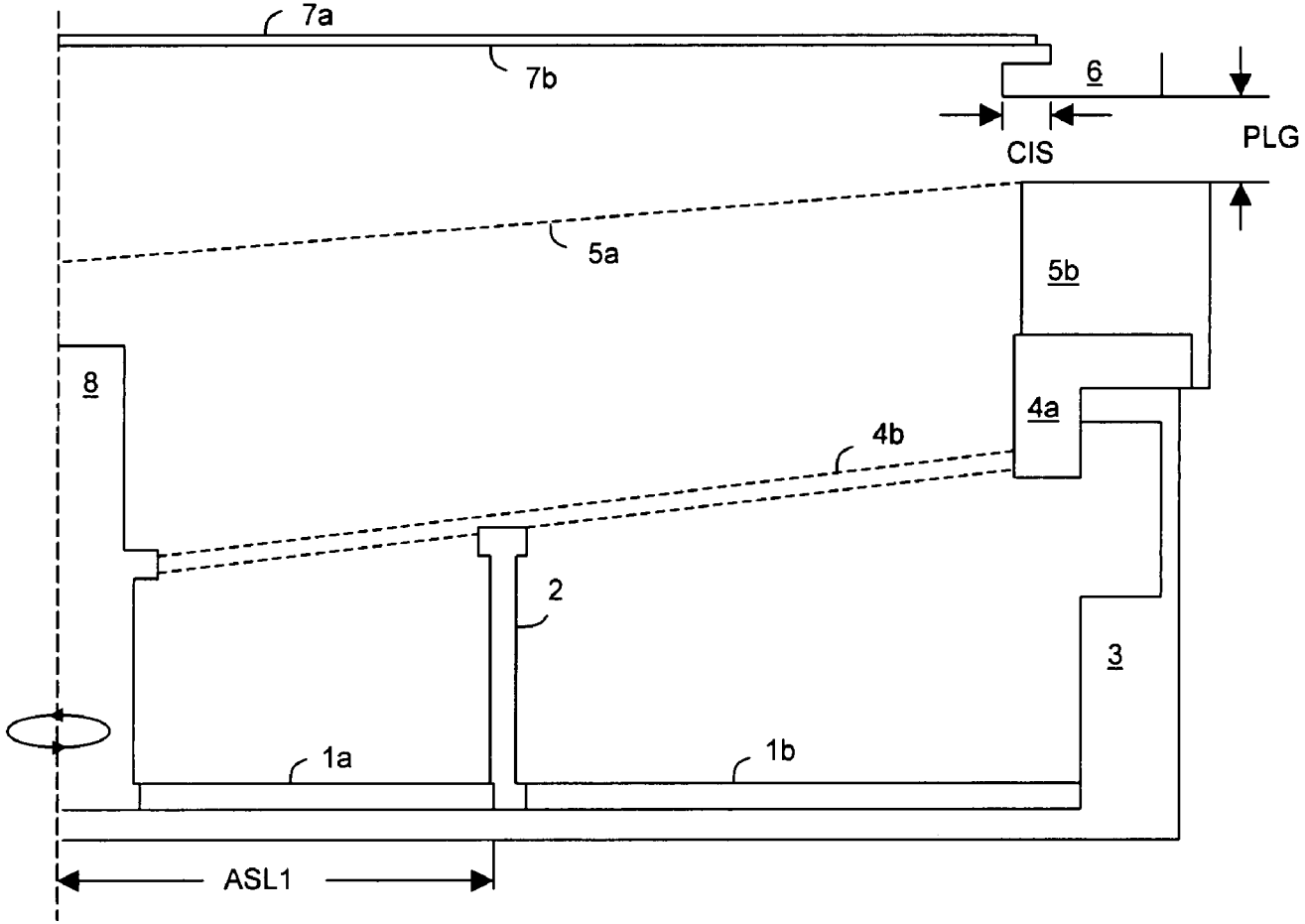
FIG. 1 ( PRIOR ART )
FIG. 1 is a cross-sectional diagram of a prior art electroplating cell.
Figure 2:
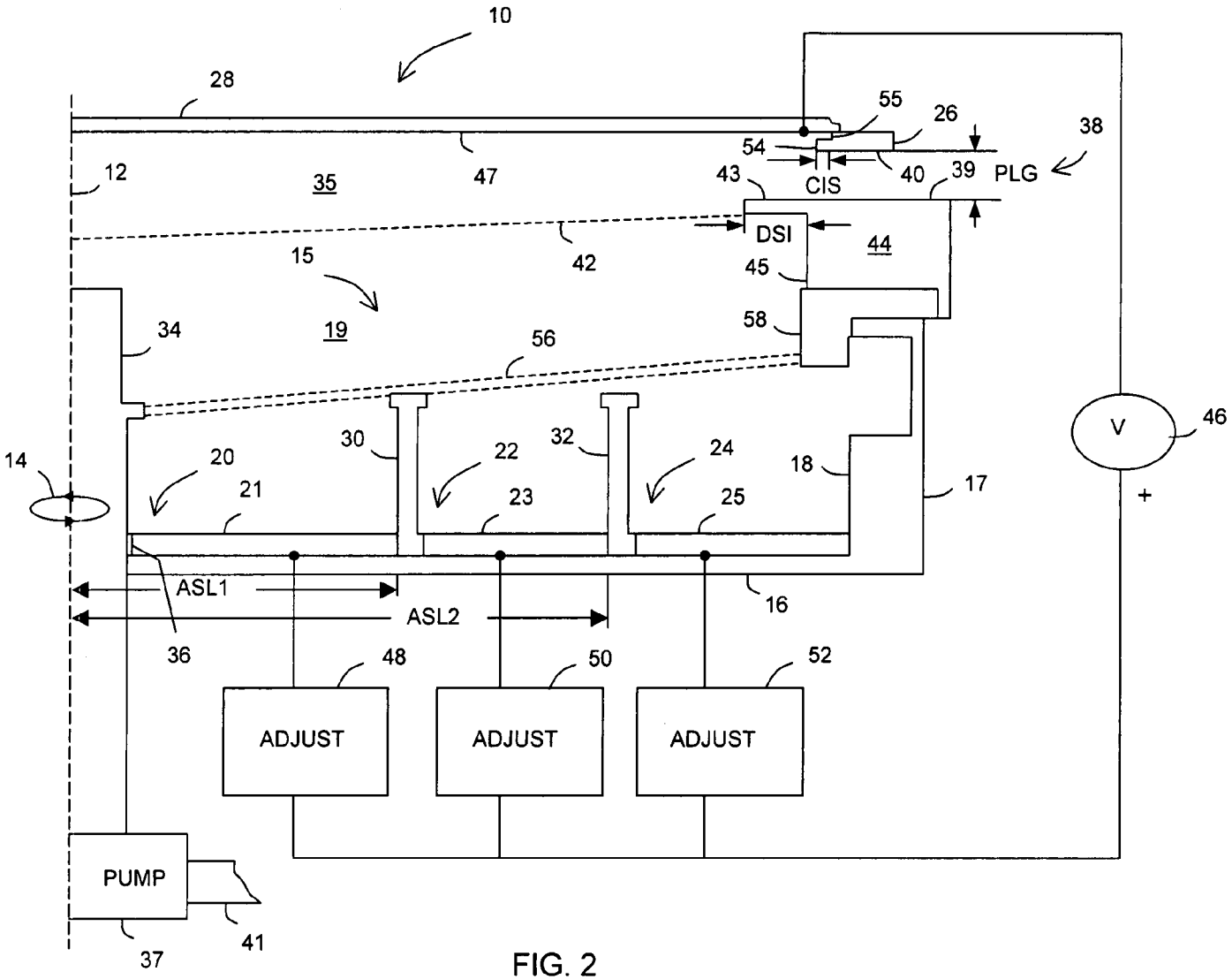
FIG. 2 is a cross-sectional diagram of an electroplating cell in accordance with one embodiment of the present invention.

FIG. 2 is a diagrammatic view of a fountain-type electroplating cell 10 according to one embodiment of the present invention. One half of a cross-sectional view of the electroplating cell 10 is shown in FIG. 2, with the cross-sectional view starting along a center axis 12 of the cell 10. The generally annular-shaped elements of the cell 10 may be visualized by a 360 degree rotation of the illustrative components of FIG. 2 about the center axis 12, as illustrated by a circular arrow 14.

The electroplating cell 10 includes a plating container 15 for containing a plating solution. In one embodiment, the electroplating cell 10 may have a cup-like configuration with the container 15 having a circular, flat base 16 and a substantially cylindrical, lateral side 17 with an interior wall 18. The base 16 and the inner wall 18 define an anode chamber 19. The illustrative plating container 15 may have a 300 mm diameter. The electroplating cell 10 includes at least three anodes mounted on the base 16: an inner anode 20 having a substantially planar inner surface 21, a middle anode 22 having a substantially planar middle surface 23, and an outer anode 24 having a substantially planar outer surface 25. With respect to the center axis 12, the middle anode 22 is positioned outside an outer periphery of the inner anode 20 and the outer anode 24 is positioned outside of an outer periphery of the middle anode 22. In one embodiment, the inner surface 21 may have a circular perimeter, i.e., a plate-like configuration and may be centered on the center axis 12. More particularly, as shown in FIG. 2, the inner surface 21 may be further modified to have a ring-like or first annular configuration to accommodate a solution inlet nozzle to be described hereinafter. The middle surface 23 may have a second annular configuration with a center located on the center axis 12 and the outer surface 25 may have a third annular configuration also concentric with the center axis 12. Hence, in this illustrative embodiment, the inner surface 21, middle surface 23, and outer surface 25 have a concentric relationship centered on the center axis 12.

Although three anodes 20, 22, and 24 are illustrated, additional anodes may be added. At the top of the interior wall 18, there may be mounted an annular wafer holder 26, which is used to removably mount a semiconductor wafer 28 to be electroplated. The three anodes 20, 22, and 24 may be disposed in substantially parallel relationship to planes of the wafer 28 and the wafer holder 26. In one embodiment, the anodes 20, 22, and 24 and their surfaces 21, 23, and 25, respectively, may be coplanar. The illustrated components of the cell 10 may have annular configurations in FIG. 2 due to the illustrative wafer 28 having a circular perimeter. However, other shaped components may be used in cases where the wafer 28 assumes peripheries that are not circular.

The anodes 20 and 22 may be separated by interposing a first anode separator 30 and the anodes 22 and 24 may be separated by interposing a second anode separator 32, with the anode separators being located at specific distances shown in FIG. 2 as Anode Separator Locations (ASLs). The distances ASL1 and ASL2 represent the radii of the anode separators 30 and 32, respectively, with each radii extending from the center axis 12. For each additional anode added, and additional anode separator may be provided. The anode separators 30 and 32 are made of an insulating material. The anode separators 30 and 32 provide upright walls, extending from the base 16, which isolate, in the lower portion of the anode chamber 19, the electrical currents from each of the anodes 20-24. In other words, the anode separators 30 and 32 significantly reduce any current flowing between the anodes 20-24. Hence, there are separate electric fields of potentially different strengths emerging from the anodes 20-24, with the electric fields merging after the anodes 20-24 into a combined electric field, although the strength of the combined electric field in a radial direction along the wafer is a function of current settings for the three anodes 20-24, as will be discussed hereinafter.

At the center of the cell 10 there may be located a solution inlet nozzle 34, formed of an electrically insulating material, which provides the plating solution to the anode chamber 19 so as to form a plating bath 35. The solution inlet nozzle 34 is positioned to extend through a center aperture 36 of the inner anode 20. The wafer holder 26 may be mounted on a rotatable spindle (not shown) which allows rotation of the wafer holder 26. During the electroplating process, the wafer holder 26 and therefore the wafer 28 are placed in contact with the plating bath 35. The plating solution is continually provided to the plating bath 35 through the solution inlet nozzle 34 by a pump 37. Generally, the plating solution flows upwards towards the wafer 28, then radially outward and across wafer 28, and then through, the wafer holder 25 via gaps created by the insert spacers (not shown). The plate gap 38 is formed between an annular, flat upper surface 39 of the plating container 15 and an annular, flat lower surface 40 of the wafer holder 26. The plate gap 38 may have an adjustable vertical distance labeled as PLG in FIG. 2. The distance PLG is one of the factors controlling the electric field between anodes 20, 22, and 24 and the cathode, i.e., the lower surface 47 of the wafer 28. The plating solution overflows the plating bath 35 and passes to an overflow reservoir (not shown). Next, the plating solution from the overflow reservoir may be filtered by a filter (not shown) and then returned to the pump 37 via a pipe 41 (partially shown), where the plating solution again passes through the solution inlet nozzle 34, thereby completing the recirculation of the plating solution. The solution inlet nozzle 34 may be designed to further have multiple holes or openings to allow various types of solution flow distribution into the plating container 15.

To assist in the distribution of the plating solution, a diffuser 42, made of a porous membrane, may be disposed to traverse the anode chamber 19 so as to intercept the flow of plating solution from the nozzle 34 and to more evenly distribute it over the wafer 28. The periphery of the diffuser 42 may be secured to an annular diffuser support collar 43, which in turn is attached to a support ring 44. The diffuser support collar 43 is formed of an insulating material and protrudes inwardly from the support ring 44 toward the center axis 12. The diffuser support collar 43, which may be positioned between the anodes 20-24 and the wafer 28, assists in shaping the electrical field in the plating bath 35 which extends from each of the anodes 20-24 to the wafer 28. The support ring 44 forms part of the interior wall 18. Hence, the inner cylindrical surface 45 of the outer support ring 44 (and therefore the interior wall 18) has a first radius about the center axis 12 and the inner circular periphery of the diffuser support collar 43 has a shorter, second radius, with the difference in the two radii being shown in the FIG. 2 as the distance DSI.

A DC power supply 46 may have a negative output electrically connected, through one or more slip rings, brushes and contacts (not shown), to a seed layer of copper deposited on the lower surface 47 of the wafer 28. Hence, the lower surface 47 may have a negative charge. The positive output lead of the power supply 46 may be electrically connected through a plurality of current adjustment circuits 48, 50, and 52, which in turn may be electrically connected to the anodes 20, 22, and 24, respectively. The current adjustment circuits 48-52 allow for the currents to each of the anodes 20-24 to be individually adjusted, as will be explained hereinafter. During use, the power supply 46 biases the wafer 28 to have a negative potential relative to the anodes 20-24, causing an electrical current to flow from the anodes 20-24 to the wafer 28. (As used herein, electrical current flows in the same direction as the net positive ion flux and opposite the net electron flux.) This causes an electrochemical reaction on the wafer 28 which results in the deposition of the electrically conductive layer (e.g. copper) of the wafer 28, thereby forming the metallic interconnects on the wafer 28. As previously mentioned, the diffuser support collar 43 provides a shield to shape the electric field extending between the anodes 20-24 and the wafer 28.

The wafer-holder 26 may have a shoulder 54 protruding from the wafer holder 26 by a distance shown as CIS in FIG. 2. More specifically, an annular wall of the wafer holder 26 may have a first radius about the center axis 12 and the shoulder 54 may have a shorter, second radius about the center axis 12, with the difference between the two radii being the distance CIS. The shoulder 54 blocks the electrical field between the anodes 20-24 and the wafer 28 from extending to that portion of the wafer 28 electrically shielded by the shoulder 54. In other words, an advantage of minimizing CIS is that there is less shielding at the edge of the wafer 28. Thus, the film thickness at the very edge will become more similar to the rest of the wafer and the overall profile becomes flatter. Effectively, the edge is thickened a small amount and thickness range or variation across the wafer is reduced. In the cell 10 according to one embodiment of the present invention, reduced shielding or no shielding by the shoulder 54 may be used, due to the shielding provided by the diffuser support collar 43; hence, the distance CIS of the shoulder 54 may be designed to be substantially zero. In other words, as the distance DSI is increased in the design of the cell 10, the distance CIS may be decreased until it becomes substantially zero. A porous anode membrane 56 may extend in traversing relationship across the anode chamber 19 between the solution inlet nozzle 34 and an outer support ring 58. The membrane 56 is used to collect particulate matter coming from the anodes 20-24 to prevent such particulate matter from interfering with the electroplating process.

The cell 10 in accordance with one embodiment of the present invention addresses the problem of the difficulty in simultaneously achieving uniform thickness profiles for thin EP (electroplating) film (incurred difficulties with "terminal effects") and for thick EP film (incurred difficulties with "edge roll-offs"), especially for high-conductivity plating baths. Combinations of selected hardware and anode current settings may provide uniform thickness profiles for a wide range of thickness (0.5 to 2 microns), while the prior art electroplating cell generally gives highly non-uniform center-thin, edge-thick profiles for thin film (approximately 0.5 microns) and center-thick, edge-thin profiles for thick films (approximately greater than 1 micron). The cell 10 is applicable for a wide range of process options, including various seed layer thickness, target film thickness, bath conductivity, and types of patterns printed on the wafer 28. An approximate 70% reduction in thickness range may be achieved for both thin and thick films over the prior art.

A model-based recipe to determine hardware and operation conditions for each given target (i.e., film profile) and seed layer thickness may be obtained. In various embodiments, the hardware parameters of the cell 10 were determined to have the following values: the distance ASL1 may be from 9 to 11 centimeters, the distance ASL2 may be adjustable, the distance DSI may be 1 to 2 millimeters, the distance PLG may be 5 to 11 millimeters, and the distance CIS may be set approximately to zero. These determined hardware parameters allow for EP (electroplating) film profiles for a wide range of target thickness, while using the same hardware geometry. With the above hardware parameters, the appropriate operation of the cell 10 may be achieved by using the empirically determining the anode currents for the anodes 20-24.

Figure 3:
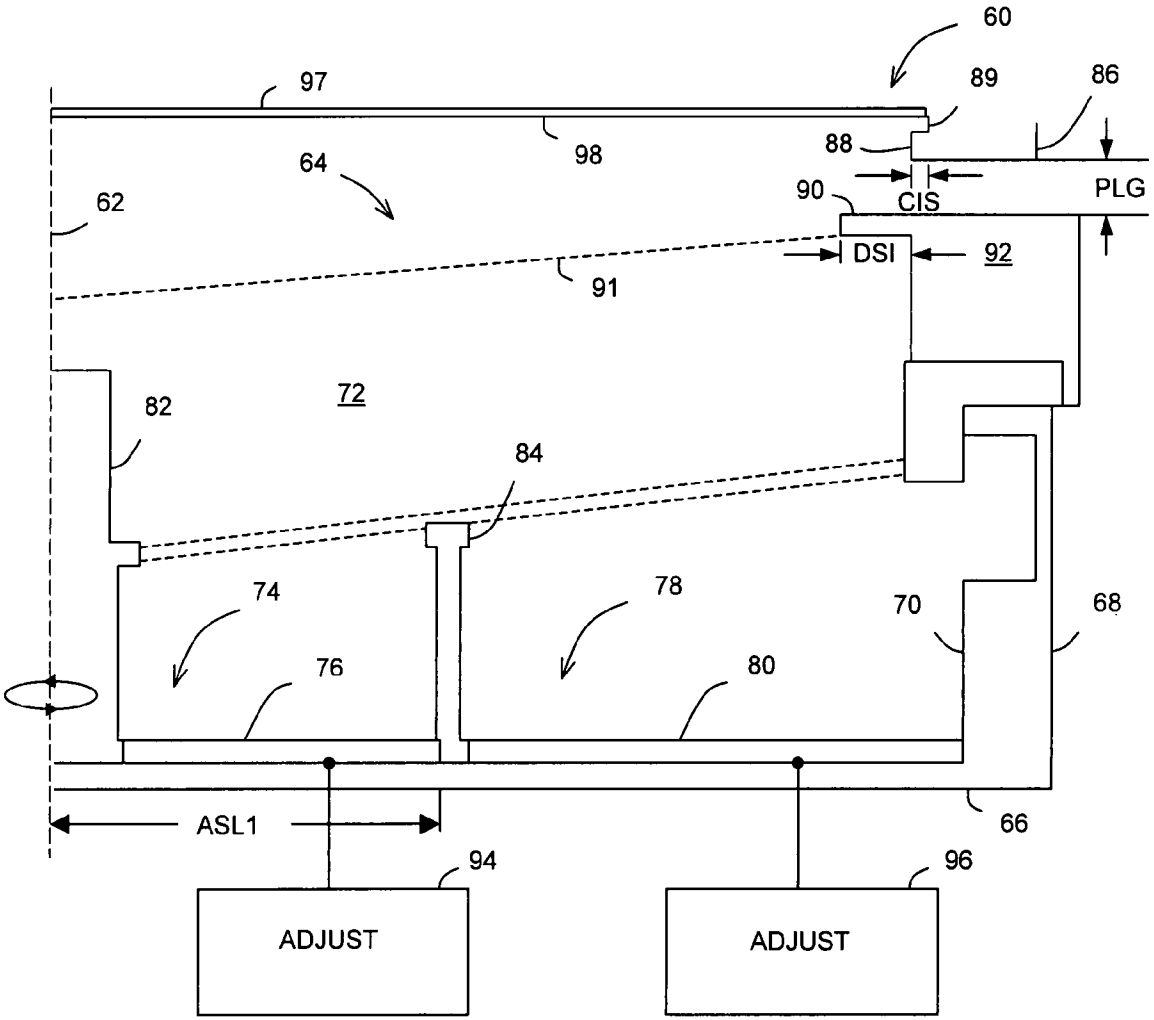
FIG. 3 is a cross-sectional diagram of an electroplating cell in accordance with another embodiment of the present invention.

Referring to FIG. 3, an electroplating cell 60 according to another embodiment of the present invention is shown. A cross-sectional view of a cylindrically-shaped electroplating cell 60 is shown, with the cross-sectional view being taken from a center axis 62 to the outer periphery of the cell 60. The electroplating cell 60 includes a plating container 64 for containing a plating solution. The electroplating cell 60 may have a cup-like configuration with the container 64 having a circular, flat base 66 and a substantially cylindrical, lateral side 68 with an interior wall 70. The base 66 and the inner wall 70 define an anode chamber 72. The electroplating cell 60 includes two anodes mounted on the base 66: an inner anode 74 having a substantially planar inner surface 76 and an outer anode 78 having a substantially planar outer surface 80. With respect to the center axis 62, the outer anode 78 is positioned outside of an outer periphery of the inner anode 74. In one embodiment, the inner surface 76 may have a circular perimeter, i.e., a plate-like configuration and may be centered on the center axis 62. More particularly, as shown in FIG. 3, the inner surface 76 may be further modified to have a ring-like or first annular configuration to accommodate a solution inlet nozzle 82. The outer surface 80 may have a second annular configuration also concentric with the center axis 62. Hence, in this illustrative embodiment, the inner surface 76 and outer surface 80 have a concentric relationship centered on the center axis 62.

The anodes 74 and 78 may be separated by interposing an anode separator 84. A wafer holder 86 (wafer not shown) may contain a shoulder 88 and an inner wall 89. An annular diffuser support collar 90, attached to a support ring 92, may be provided to constrain the diameter of an electrical field. The diffuser support collar 90 is mounted to the plating container 64 between the wafer holder 86 and the anodes 74 and 78 and extends inwardly into the anode chamber 72 of the plating container 64. A porous diffuser 91 is affixed to the diffuser support collar 90 and is disposed in traversing relationship to the anode chamber 72. Since there are two anodes 74 and 78, there are two current adjustment elements 94 and 96. The rest of the circuit for generating the electric field between the anodes 74 and 78 may be the same as in FIG. 2. A wafer 97 has a lower surface 98 which touches or is wetted by the plating solution in the plating container 64 during the plating process.

The various distances ASL1, DSI, PLG, and CIS are shown and defined in the same manner as with the embodiment of FIG. 2. The hardware parameters for this two anode embodiment may be determined to be as follows: the distance ASL1 is 6.5 centimeters, the distance DSI is 1.3 millimeters, the distance PLG is 5 to 11 millimeters and the distance CIS is 7 millimeters. In general, the cell 60 is the same as cell 10 except there are two anodes instead of three anodes and there are different resulting hardware parameters. With respect to other components, the cell 60 is the same as cell 10 and these components are not described again.

Figure 4:
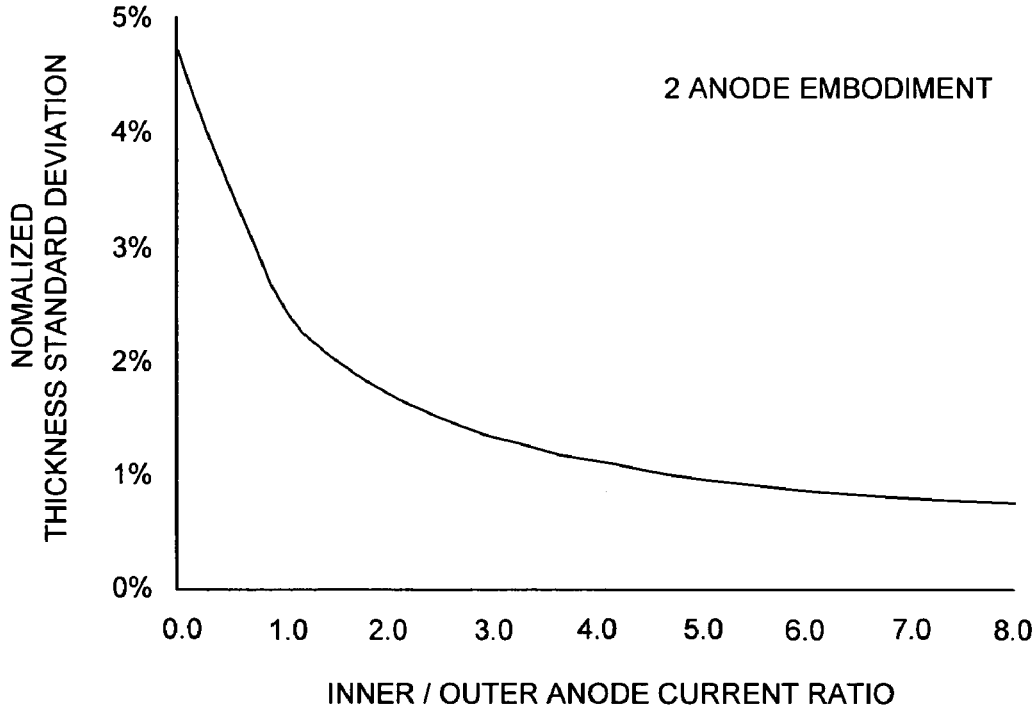
FIG. 4 is a current ratio chart for the embodiment of FIG. 3 for thin films.
Figure 5:
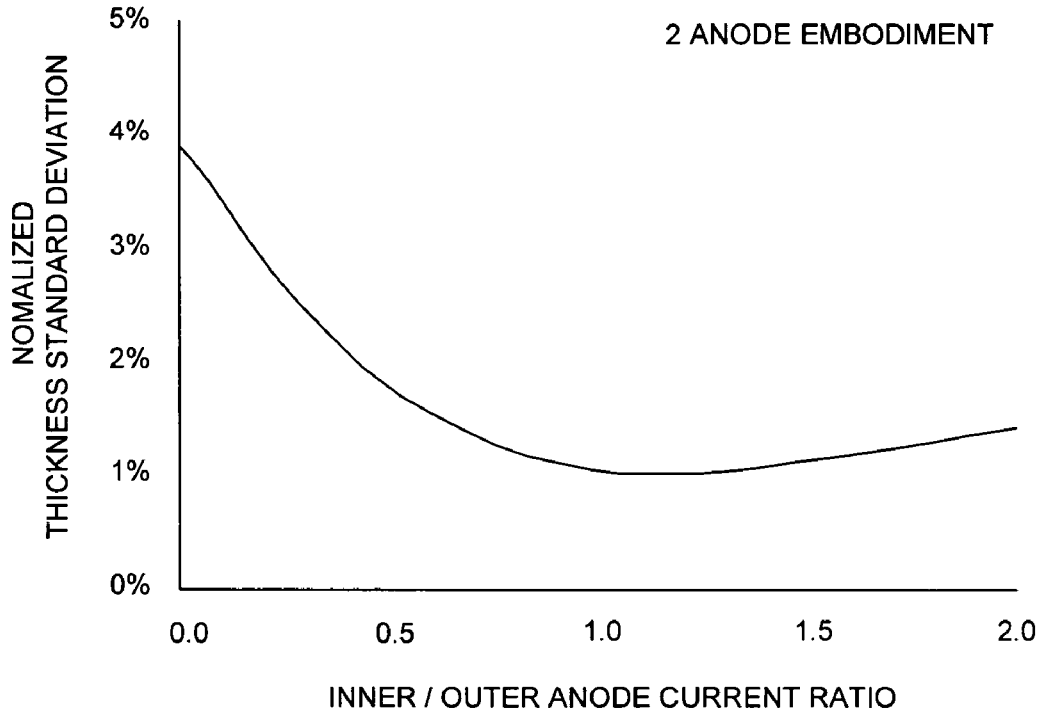
FIG. 5 is a current ratio chart for the embodiment of FIG. 3 for thick films.

With reference to FIGS. 4 and 5, for various hardware configurations of the electroplating cell 60 of FIG. 3, multiple combinations of possible values of inner/outer anode current ratios may be used, leading to an advantage of wider regions of operation conditions which may be used to further improve film uniformity, deposit properties, or process throughput. The current ratio charts in FIGS. 4 and 5 were determined using an electroplating simulation computer program to be described hereinafter, for the electroplating cell 60 of FIG. 3. Simulations were done with an applied total current ranging between 20 and 30 Amperes, with plating duration set by the times required to achieve the target thicknesses. A similar approach may be used, and new current ratio charts may be generated, for plating recipes that include multiple steps with different total current and different time duration for each step. Plating performance as measured by the across-wafer deposited film uniformity may be described in the charts for a wide range of anode current ratio values. This eliminates the need by the user to perform numerous experiments with different current ratios and empirically determine the appropriate inner and outer current settings for a desired uniformity target.

The multiple combinations of inner and outer current ratios are shown in FIGS. 4 and 5 for the two anode electroplating cell 60 of FIG. 3, with FIG. 4 being used for thin films and FIG. 5 being used for thick films. With respect to the values on the X-axis of FIGS. 4 and 5, these are the ratios of inner-to-outer anode currents (for the dual anode embodiment of FIG. 3), respectively, in a plating recipe for a 300 mm wafer. A value of zero means all anode currents go through the outer anode. A value of one means the amounts of current going through the inner and outer anodes are identical. The values on the Y-axis of FIGS. 4 and 5 are the standard deviation of thickness profile ("one-sigma") normalized with respect to the average copper film thickness. The normalized thickness standard deviation is the across-wafer thickness standard deviation (sigma) divided by the average thickness across-wafer. For example, if the standard deviation is 1000 Angstrom, and the average thickness is 10000 Angstrom, then the normalized thickness standard deviation is 1000/10000=10%. Also, since the average thickness is known (approximately 0.5 microns for thin films and 1.0 microns for thick films), the standard deviation may be determined from the charts. Lower values on the Y-axis correspond to better across-wafer uniformity. To achieve a specific uniformity target for thin and thick films, appropriate settings for the inner/outer anode current ratio may be obtained by following the curves in FIGS. 4 and 5. In summary, the adjustable current ratio settings of FIGS. 4 and 5 for the individual anodes 74 and 78 are based upon the above described determined hardware parameters, the conductivity of the plating bath used, thickness and resistance of the seed layer, and the copper film thickness targets. For the case shown in FIG. 5, the best uniformity may be achieved for ratio of inner to outer anode currents of approximately 1.1.

Figure 6:
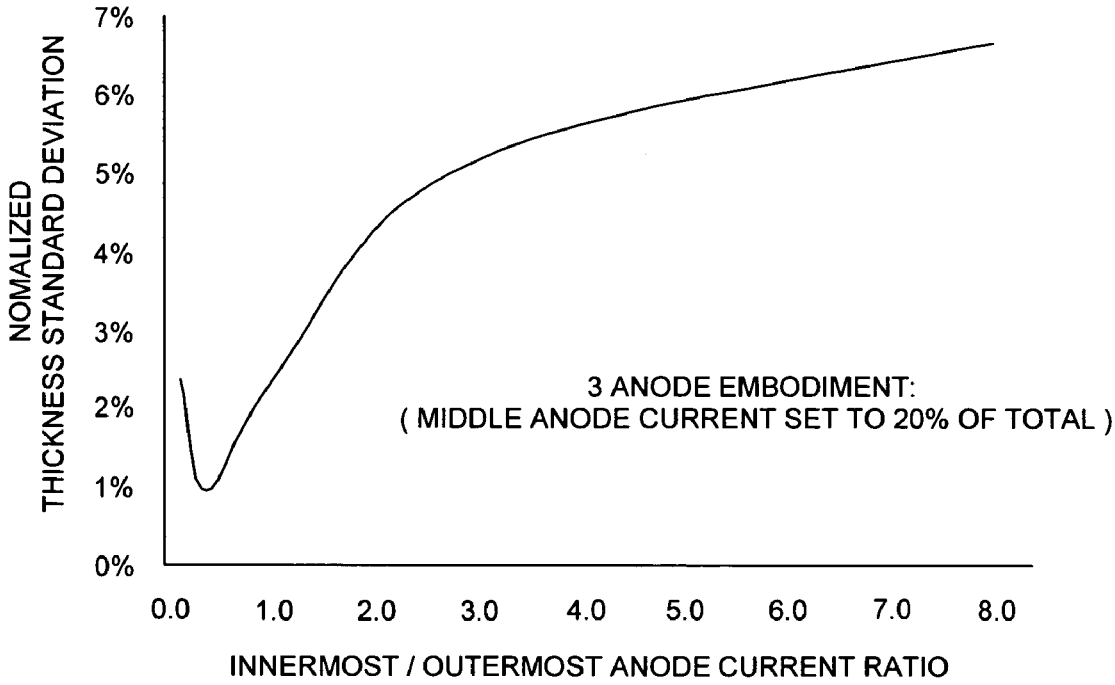
FIG. 6 is a current ratio chart for the embodiment of FIG. 2 for thick films.

As shown in FIG. 6, similar charts have been developed for the 3 anode electroplating cell 10 of FIG. 2, with there being an inner to middle anode current ratio, a middle to outer anode current ratio, or inner to outer anode current ratio selected for the embodiment of FIG. 2. Combinations of the inner and outer current ratios for the cell 10 of FIG. 2 are shown in FIG. 6 for thick-film plating cases where the middle anode current is fixed at 20% of the total current. For this case, the best uniformity may be achieved for ratio of inner to outer anode currents of approximately 0.35.

The hardware and process recipe determinations were performed using a modeling-based procedure based on an electroplating software tool or simulation computer program described hereinafter, which was developed to select desirable electroplating for copper interconnects. The modeling-based procedure includes the following steps: (1) determination of hardware dimensions of the plating container or cup; (2) determination of accurate physical properties of the plating bath; (3) validation of the simulation software results from the simulation computer program against thickness profile data obtained using the same plating cup hardware and specified process recipe; (4) running the simulation computer program for a selected hardware configuration input and chosen range of operating conditions (for example: a range of anode current ratios); (5) determination of copper film thickness uniformity (thickness average, standard deviation, and range) for each simulation case; (6) creation of current ratio chart(s) which summarize expected plating performance for the selected hardware and chosen range of operating conditions. The steps 4-6 may be repeated for each hardware configuration being considered. A desired plating recipe that leads to good plating performance may be obtained from these charts by identifying and selecting hardware configuration(s) and operating condition(s) that lead to the desired plating uniformity.

Figure 7:
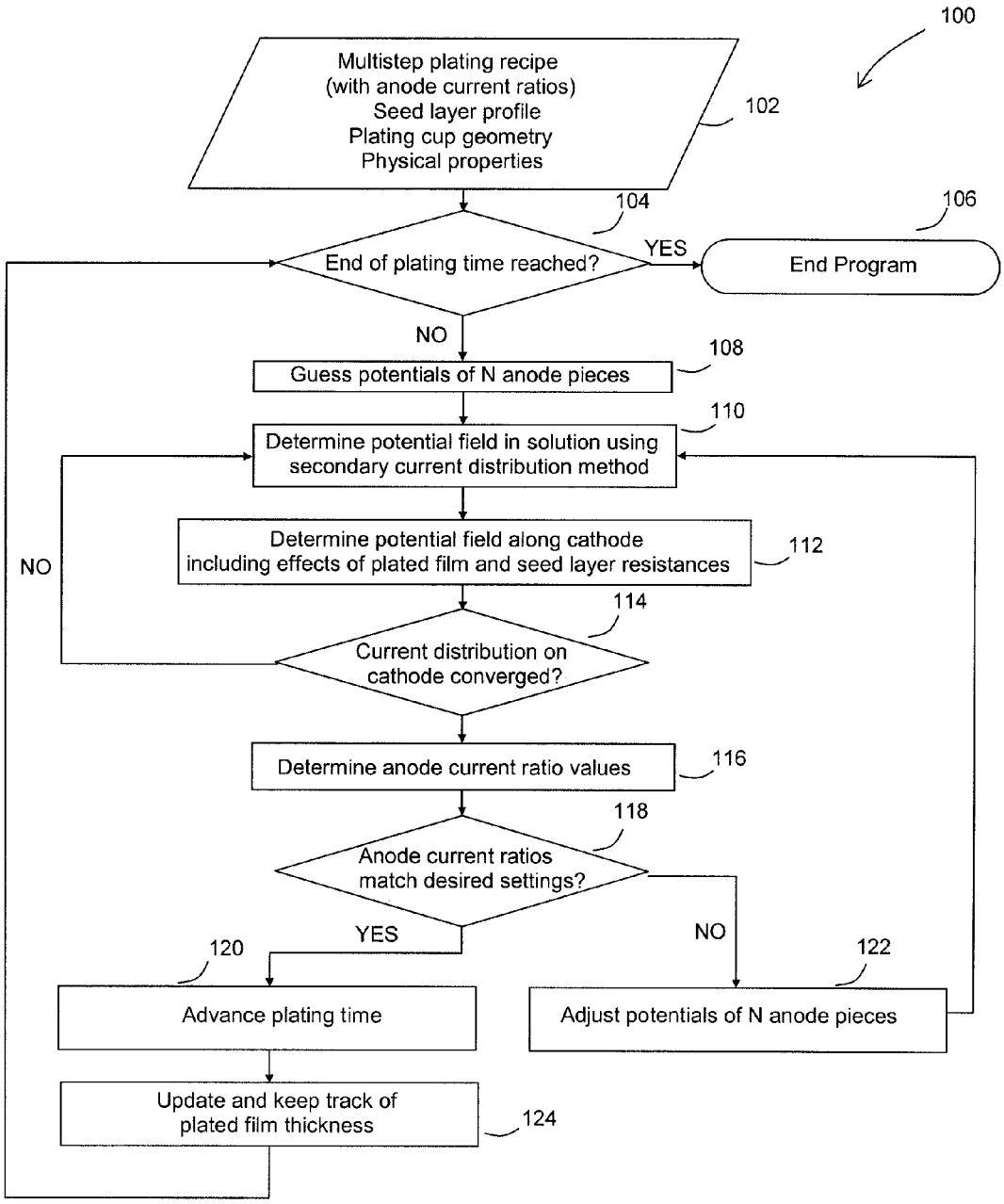
FIG. 7 is a flow chart of a simulation computer program used to generate the current ratio charts for the electroplating cells of FIGS. 2 and 3.

Referring to FIG. 7, a flow chart of the previously mentioned simulation computer program, identified by reference numeral 100, is shown. The simulation computer program 100 may be based on a secondary or tertiary current distribution model for plating, which correlates with the two anode electroplating cell 60 of FIG. 3. The simulation computer program 100 also may be based on a secondary or tertiary current distribution model for plating, which correlates with the three anode electroplating cell 10 of FIG. 2. The simulation computer program 100 may include the following capabilities: general 2-dimension plating cup geometry with detailed anode(s), cathode(s), and shielding components; multiple, independently-controlled anode pieces; multi-step plating recipes with specifiable electrical current setting for each step; transient instead of steady-state plating operation; thickness profile determination at any stage in the multi-step plating process, rather than current-density distribution; and uniform and non-uniform seed-layer (substrate) thickness profiles and resistances. The simulation computer program 100 may be designed to minimize the previously described normalized standard deviation, instead of the unnormalized deviations, since the average thickness may vary from experiment to experiment.

Referring to FIGS. 2, 3 and 7, the steps of the simulation computer program 100 are now described. For each simulation, a set of anode current ratio values is entered as input to the simulation computer program. To generate each of the current ratio charts of FIGS. 4-6, multiple runs of the simulation computer program are required, with each different run having different selected anode current ratio settings. An optimized anode current settings may then be determined from the current ratio chart(s). During the plating process, a potential (electrical) field in the plating bath 35 and across the cathode (lower surface 47 of the wafer 28) and anodes (two or three, depending on the embodiment) may be determined in an iterative process shown in FIG. 7. Initial parameters are inputted at a step 102. Such initial parameters may include a specified multistep plating recipe with a selected set of anode current ratio values, a seed layer profile, a plating cup geometry, and physical properties. At step 104, if a predetermined plating time has been reached, then the program 100 exits via an end program step 106. If the predetermined time has not occurred, then the program advances to step 108, where the program 100 selects guesses for the potentials of N anodes (anode pieces).

After step 108, the program 100 may enter an inner iteration loop including steps 110, 112, and 114. An inner iteration loop may be designed to solve for the potential field values and the current distribution on the cathode so to match the total current applied to the system by the anodes. This may include a self-consistent solution of the potential field in the plating bath and on the cathode surfaces, taking into consideration the finite resistance due to the underlying layer(s). This finite resistance depends on the profile of the seed layer and also on the deposited copper film up to that time. At step 110, the program 100 may determine the potential field in the bath solution using a secondary current distribution method. Alternatively, a tertiary current distribution method may be used instead of the secondary current distribution shown in FIG. 7. At step 112, the program 100 may determine the potential field along the cathode including any effects of the plated film and seed layer resistances. At step 114, the program 100 may determine whether the current distribution on the cathode has converged. If no, then the program 100 may branch back to step 110 to continue the inner iteration loop. If yes, the program may proceed to step 116 and may exit the inner iteration loop.

An outer iteration loop may be designed to solve and match the anode current(s) to the specified value(s) in the plating recipe provided as input parameters at the step 102. At the end of the outer iteration loop, at each particular time during plating, the potential field values in the plating bath and on the surfaces, current distribution on the cathode, and anode currents may be determined. The plated film thickness may be recorded and the entire procedure may be repeated until the desired total plating time is reached. More specifically, at step 116, the program 100 may determine the anode current ratio values for the potential fields determined by the inner iterative loop. At step 118, if these determined anode current ratios match the desired anode current ratios inputted at step 102, then the program 100 may proceed to step 120. If there is no match, then the program 100 may proceed to step 122. At step 122 the program may adjust the potentials of the N anode pieces and then branch back to the step 110 to repeat the inner iterative loop. If instead the program advances to the step 120, then at the step 120 the simulation time may be advanced. At step 124, the program 100 updates and keeps track of the plated film thickness. Then the program 100 proceeds to the step 104.

The technical advantages of the electroplating cells 10 and 60 according to two embodiments of the present invention may include: (i) improved film uniformity for a multiple-anode configuration compared to current state-of-the-art methods, with thickness range of 125 Å versus 400 Å for 0.5 micron film, and thickness range of 365 Å versus 1240 Å for 1 micron film, (ii) a hardware that allows uniform profiles for EP metal layers by changing current settings for the various anodes, (iii) a hardware that allows uniform profiles for various values of seed layer thickness, and (iii) a hardware applicable for both high conductivity ("high acid") and low conductivity ("low acid") baths.

Figure 8:
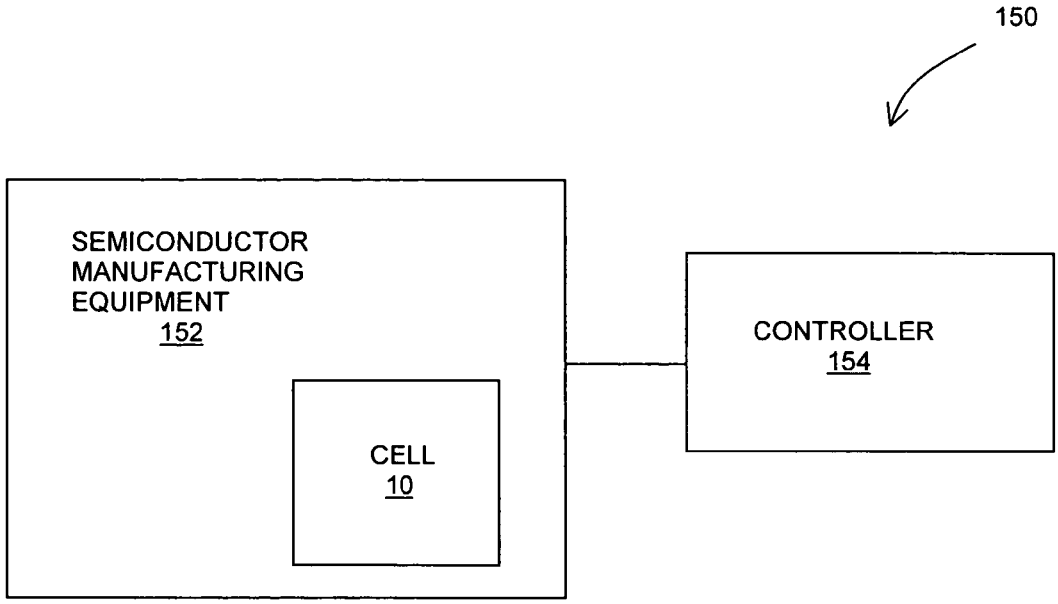
FIG. 8 is a block design of a system incorporating the electroplating cell in accordance with one embodiment of the present invention.

FIG. 8 is a block diagram representation of a semiconductor manufacturing system 150, typically found in a semiconductor manufacturing facility, for processing semiconductor wafers to produce any number of semiconductor products, such as DRAMs, processors, etc. The system 152 includes semiconductor manufacturing equipment 154 having a plurality of modules, such as physical vapor deposition (PVD) modules, copper wiring modules, dep-etch modules, and the like. Thus, wafers are passed from one module to another where any number of operations may be performed, the ultimate goal of which is to arrive at a final integrated circuit product. Each module may include any number of tools to process wafers, with the copper wiring module including as one of the tools the electroplating cell 10 of FIG. 2 in accordance to one embodiment of the present invention. Alternatively, the electroplating cell 60 of FIG. 3 may be included in place of the electroplating cell 10. Other tools may include chemical vapor deposition, etch, copper barrier seed tools, chemical-mechanical polishers and the like. Thus, similar to the module level, wafers are passed from one tool to another where any number of operations may be performed. Control of the various modules and tools is provided by a controller 154, which steps the wafers through the fabrication process to obtain the final product.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. A method, comprising:

providing an anode chamber with at least two concentric anodes including an inner anode and an outer anode;

generating a computer generated model with a simulation computer program;

selecting at least one current ratio from the computer generated model, with the computer generated model having a plurality of current ratios from which the at least one current ratio is selected and the one current ratio being a ratio of an inner electrical current to an outer electrical current;

applying the inner electrical current to the inner anode and the outer electrical current to the outer anode;

adjusting the inner and outer electrical currents to incorporate the one current ratio; and wherein the generating of the computer generated model with the simulation computer program includes using a first iterative loop to determine a potential field in the anode chamber.

2. The method according to claim 1, wherein generating the computer generated model with the simulation computer program further includes using the first iterative loop to determine whether a current distribution over a cathode in the anode chamber matches a total current applied to the at least two anodes.

3. The method according to claim 2, wherein generating the computer generated model with the simulation computer program further includes using a second iterative loop to determine if a plating time has been reached.

4. The method according to claim 3, wherein generating the computer generated model with the simulation computer program further includes repeatedly running the simulation computer program once for each of the plurality of current ratios.

5. The method according to claim 1, further comprising:

generating a flow of plating solution;

restricting a diameter of an electric field in the plating solution created by the inner and outer electrical currents at a positioned between the anodes and a wafer holder.

6. The method according to claim 1, wherein the at least two concentric anodes include at least three concentric anodes including an inner, a middle and an outer anode.

* * * * *

UNITED STATES PATENT AND TRADEMARK OFFICE

CERTIFICATE OF CORRECTION

PATENT NO. : 7,279,084 B2
APPLICATION NO. : 10/773643
DATED : October 9, 2007
INVENTOR(S) : Chalupa et al.

It is certified that error appears in the above-identified patent and that said Letters Patent is hereby corrected as shown below:

Figures 4, 5 and 6
NOMALIZED should be NORMALIZED

Column 10
Line 41, "...at a positioned..." should read --...at a position...--.

Signed and Sealed this

Seventeenth Day of March, 2009

JOHN DOLL
*Acting Director of the United States Patent and Trademark Office*